United States Patent [19]

Earley et al.

[11] Patent Number: 4,562,850

[45] Date of Patent: Jan. 7, 1986

[54] COMBINATION WALKING CANE, PATH LIGHT AND UPRISAL DEVICE

[76] Inventors: Ronald Earley, 212 Westbrook Dr.; Marvin Higginson, 2941 Flowerbrook Ct., both of Springfield, Ill. 62702

[21] Appl. No.: 638,806

[22] Filed: Aug. 8, 1984

[51] Int. Cl.[4] ..... A45B 3/04; A45B 9/02

[52] U.S. Cl. ..... 135/66; 135/DIG. 10; 362/102

[58] Field of Search ..... 135/DIG. 10, DIG. 11, 135/75, 66, 65, 82, 68; 362/102; D3/5, 6, 7, 8, 9

[56] References Cited

U.S. PATENT DOCUMENTS

| | | | |
|---|---|---|---|
| D. 207,764 | 5/1967 | Lozo et al. | 135/66 X |
| 2,675,014 | 4/1954 | Powers | 135/82 |
| 3,289,685 | 12/1966 | Parker | 135/65 |
| 3,336,469 | 8/1967 | Barnes, Sr. et al. | 362/102 |

FOREIGN PATENT DOCUMENTS

| | | | |
|---|---|---|---|
| 842114 | 6/1952 | Fed. Rep. of Germany | 362/102 |
| 630515 | 6/1982 | Switzerland | 135/DIG. 10 |
| 2043 | 7/1862 | United Kingdom | 135/65 |
| 381285 | 10/1932 | United Kingdom | 135/66 |
| 2110081 | 6/1983 | United Kingdom | 135/DIG. 10 |

*Primary Examiner*—Robert A. Hafer
*Assistant Examiner*—Arnold W. Kramer
*Attorney, Agent, or Firm*—Edwin E. Greigg

[57] ABSTRACT

A combination walking cane, path light and uprisal assistance device is provided by the invention. The shaft of the walking cane is adjustable in length to suit the user. The handle of the device is provided with a switch to operate an illumination device mounted near the base of the cane shaft. The upper extremity near the rebent portion of the cane is provided with a flange or collar allowing the user a better grip and improved leverage in rising from a seated position to a standing position.

5 Claims, 4 Drawing Figures

FIG 1
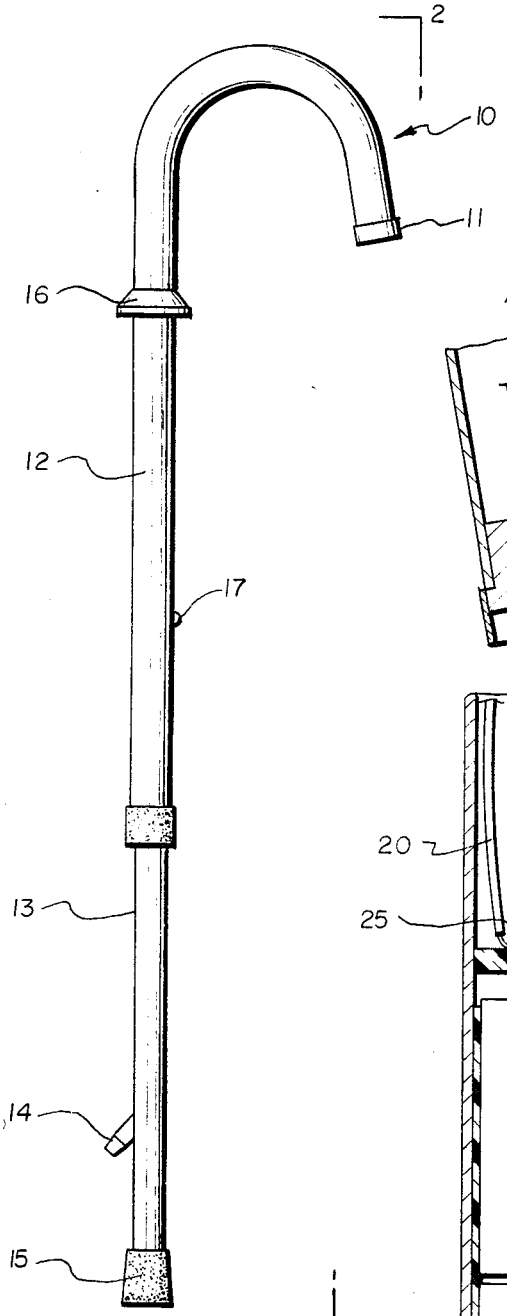
FIG 2
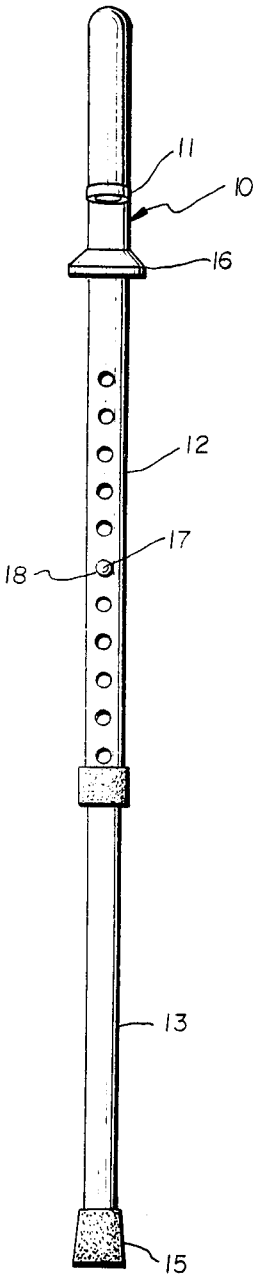
FIG 3
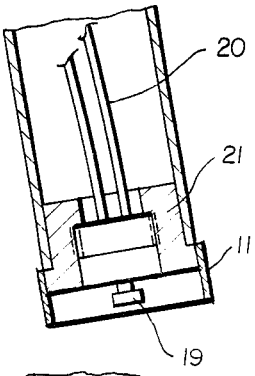
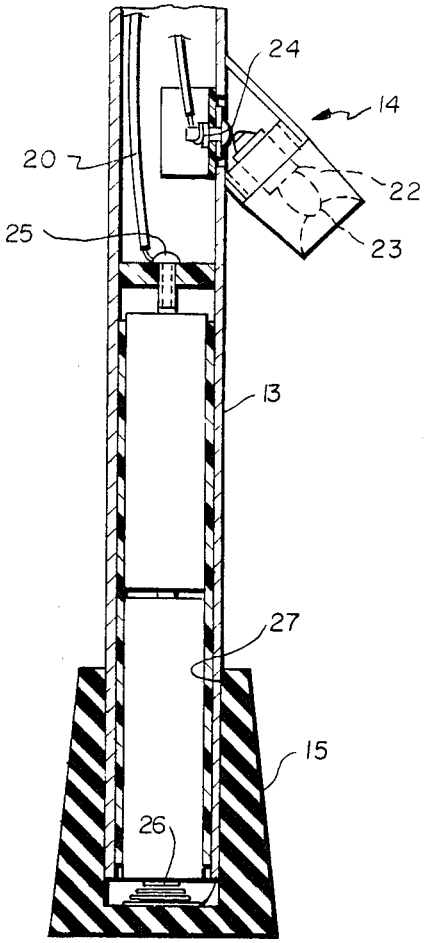
FIG 4

COMBINATION WALKING CANE, PATH LIGHT AND UPRISAL DEVICE

BACKGROUND OF THE INVENTION

1. Field of the Invention

This invention relates to a walking cane provided with a flashlight for illuminating the path of the ambulatory user and further provides a device in the nature of a collar provided on the shaft of the cane to assist the user is rising from a seated position.

2. Brief Description of the Prior Art

Many attempts have been made in the prior art to deal with the problem of ambulatory assistance devices for the elderly or the handicapped. Canes or walking sticks have been provided with various accessories as are noted in the following prior art patents.

The most pertinent prior art patents for walking canes provided with accessories of various types may be found in U.S. Pat. No. 2,478,325 to Russell; 2,580,888 to Burkett; 2,597,172 to Parker; 3,336,469 to Barnes, Sr. et al; 4,013,881 to Sargent; and 4,062,371 to Bolen.

The Russell patent sets forth a walking cane having a handle in which batteries are provided for operating a light which shines downwardly from the handle, the light being operated by a switch on the handle. The Burkett patent is directed to a crutch which is adjustable in length and provided with a light which aids the user; a switch is provided in the hand crosspiece controlling the light. The patent to Parker relates to an illuminated cane which has a lower section provided with batteries to operate a plurality of lights directed outwardly from the cane. The patent to Barnes, Jr. is directed to a walking cane including a tubular portion provided with batteries that operate a light to a switch mounted on the side of the cane. The light is directed downwardly at an angle relative to the body of the cane. The patent to Sargent sets forth a walking cane equipped with a light, batteries and a switch. The switch is on the handle and the light is adapted to shine upon reflections that direct the light out from the cane. The patent to Bolen is directed to a walking cane equipped with a battery operated light that is controlled by a switch in the handle. Means are provided for recharging the batteries.

In spite of the fact that the foregoing references include canes or other walking assistance devices provided with illumination, none of the foregoing patents in the prior art have dealt specifically with the problem presented by the seated handicapped or elderly person, who has great difficulty in arising to a standing position from the seated position. The instant invention is directed to providing a cane with all of the desirable features that a handicapped person or the elderly are believed to find useful and for which a long felt need has existed.

OBJECTS AND SUMMARY OF THE INVENTION

Accordingly, the invention may be summarized as follows:

The combination cane, light and seated to standing assistance means comprises a cane with a rebent top portion in the end of which is mounted a switch means for operation of a light mounted on a lower forward extremity of the cane shaft above the foot thereof, and at an angle so that it will shine forth an illuminated path for the user of the cane. In addition, means are provided for an adjustment of the length of the cane to suit the individual user. Further, a flange or disk is mounted upon the shaft near its upper extremity, the purpose of which flange is to serve as a grasping means below the full vertical extent of the cane handle. The inventor has found that the addition of such an assistance device as is provided for in this invention offers greater utility to the user by not being at the full vertical height of the cane. It has been found that the geometry of the seated person and their attempt to arise are assisted by, and given greater leverage, by the supply of a flange or disk upon the shaft at a lower height than the full vertical extent of the cane.

In accordance with the foregoing it is an object of the invention therefor to provide a walking cane, which includes in combination means for adjusting the length thereof, path illumination means operable by a switch mounted in the upper handle extremity, and flange means to assist the user in arising from a seated position.

It is another object of the invention to provide that the switch means is mounted in the upper handle extremity, in a position that could be reached by a finger of the user's hand without removal of the hand from the cane.

Still another object of the invention is to provide that the path illumination means comprise a light mounted to shine in front of the user outwardly and downwardly at an angle to the shaft.

Other objects and advantages of the invention will become apparent by reference to the description and the accompanying drawings.

BRIEF DESCRIPTION OF THE DRAWINGS

The present invention may best be understood by reference to the following description, taken in connection with the accompanying drawings, in which:

FIG. 1 is a side elevation view of a walking cane in accordance with the invention showing the light and the standing assistance flange means;

FIG. 2 is a view along line 2—2 of FIG. 1 viewing the cane from the rear and clearly showing the adjustment means for the length of the cane in accordance with the invention;

FIG. 3 is a detailed view in partial cross section of the upper extremity of the cane showing the mounting and wiring for the light switch; and FIG. 4 is a partial cross section of the lower extremity of the cane showing the mounting of the light with respect to the foot of the cane.

DESCRIPTION OF THE PREFERRED EMBODIMENT

Referring now to FIG. 1, reference numeral 10 designates generally the walking cane in accordance with the invention, provided with an upper extremity 11, a rebent portion forming the handle which extends downwardly into a shaft 12 and a further shaft 13, means being provided for the adjustment of the length of shaft 13 into the surrounding shaft 12. Further shown in FIG. 1 are the illuminating device 14, the foot of the cane 15, the flange means 16 which assists the user in arising to a standing position from a seated position, and the length adjustment means 17.

FIG. 2 shows substantially the same elements of the cane as FIG. 1 but more clearly depicts the cane length adjustment means which comprises offstanding but depressible against a spring bias button 17 which can be located in apertures 18, a number of which are shown in shaft 12. In practice, the button 17 is depressed and allowed to be relocated into another aperture higher or lower on shaft 12 depending upon the height of the cane the user desires.

FIG. 3 depicts the handle extremity 11 into which has been mounted a switch means 19 with associated wiring 20 mounted in a block 21 received in the end 11 of cane 10. As can be seen in this view, switch 19 can be depressed by a finger to actuate the light on or off.

FIG. 4 shows the lower extremity of the cane including shaft 13 and the mounting of light 14 with respect thereto. This partial cutaway view shows wiring 20 terminating in a positive means 25 and a connection means 24 for making contact with the positive contact of the light 14, which comprises socket 22 and bulb 23.

The socket 22 is grounded to the first cane portion 13 and completes the circuit to the light bulb via the shaft portion 13 and the spring 26 which is in contact with the ground end of the battery such as is well known in a common flash light or in U.S. Pat. No. 3,336,469. The spring 26 also functions as a shock absorption means provided at the base of shaft 13, shaft 13 and the spring means being provided in a bore 27 within the foot 15. As is shown in the drawing, and is typical in the art, the invention comprehends that foot 15 would be of a rubber or other nonslip composition material to assist the user in ambulating.

In use, the user would grasp the upper portion of handle 12 where the same is rebent, the placement of the hand being convenient to operate the switch 19 for the light 14. In order to take advantage of the flange means 16, in a seated position a user would grasp the flange at the shaft of the cane and use the flange as a means to increase the leverage provided by the arms in lifting the body into a standing position. In this maneuver, the flange could be used by one or both hands so as to increase the leverage of the user in propelling himself into a standing position.

While particular embodiments to the invention to the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of the invention as defined by the following claims.

What is claimed and desired to be secured by Letters Patent of the United States is:

1. A combination walking cane path light and uprisal assistance device comprising a cylindrical hollow first shaft means and a cylindrical hollow second shaft means, said second shaft means including a U-shaped handle on an upper end, a plurality of aligned, spaced apertures in a wall of said second shaft means extending from a lower end toward said U-shaped handle in a linear alignment, a fixed flange means surrounds said second shaft means and is secured thereto between said U-shaped handle and said aligned apertures in a wall thereof, said first shaft means having an outer diameter substantially the same as an inner diameter of said second shaft means and including an upper end that extends into said lower end of said second shaft means, said first shaft means provided with foot means on the lower end thereof, a spring biased releasable button on said upper end of said first shaft means for reception by one of said spaced apertures in said second shaft means for adjusting said first shaft means relative to said second shaft means in order to adjust an overall length of said cane, a light means secured to said first shaft means along the length thereof and extending downwardly therefrom at an angle relative to the wall surface thereof, battery means secured within said first shaft means between a bottom end and said light means, a light switch means within and surrounded by the end of said second shaft means formed by said U-shaped handle, and electrical conductor means extending between said battery means, said light means and said switch means for operation of said light means, whereby a user may operate said light by use of said switch and may be assisted in arising from a nonstanding position by use of said flange means secured to said second shaft means.

2. The combination walking cane, path light and uprisal assistance device in accordance with claim 1 wherein said light switch means is a push button switch and said battery means comprises flashlight batteries.

3. The combination walking cane, path light and uprisal assistance device in accordance with claim 1 wherein said light means is mounted so as to cast illumination 12 to 15 inches ahead of the user.

4. The combination walking cane, path light and uprisal assistance device in accordance with claim 1 wherein the lower end of said first shaft means is mounted in a bore in said foot means and a shock absorbing means is provided therebetween.

5. The combination walking cane, path light and uprisal assistance device in accordance with claim 4 wherein said shock absorbing means is a spring and said foot means is comprised of a non-slip composition material.

* * * * *